US007719242B2

(12) United States Patent
Negoro

(10) Patent No.: US 7,719,242 B2
(45) Date of Patent: May 18, 2010

(54) VOLTAGE REGULATOR

(75) Inventor: Takaaki Negoro, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 401 days.

(21) Appl. No.: 11/822,116

(22) Filed: Jul. 2, 2007

(65) Prior Publication Data

US 2008/0012543 A1 Jan. 17, 2008

(30) Foreign Application Priority Data

Jul. 13, 2006 (JP) ..... 2006-192873

(51) Int. Cl.
*G05F 1/00* (2006.01)
*G05F 1/569* (2006.01)

(52) U.S. Cl. ..... 323/273; 323/276

(58) Field of Classification Search ..... 323/268–270, 323/272, 273–281
See application file for complete search history.

(56) References Cited

U.S. PATENT DOCUMENTS 5,479,093 A * 12/1995 Jeon ..... 323/313
6,586,958 B2 * 7/2003 Sudo et al. ..... 324/765
7,170,265 B2 * 1/2007 Whittaker ..... 323/267
7,301,315 B2 * 11/2007 Noda ..... 323/280

FOREIGN PATENT DOCUMENTS

| | | |
|---|---|---|
| JP | 61-52717 | 3/1986 |
| JP | 3-26280 | 3/1991 |
| JP | 2525450 | 11/1996 |
| JP | 3391329 | 1/2003 |
| JP | 3555239 | 5/2004 |
| JP | 2005-137190 | 5/2005 |
| JP | 2006-34033 | 2/2006 |

* cited by examiner

*Primary Examiner*—Bao Q Vu
*Assistant Examiner*—Jue Zhang
(74) *Attorney, Agent, or Firm*—Dickstein Shapiro LLP

(57) ABSTRACT

A voltage regulator is disclosed that includes an output transistor outputting a current according to an input control signal to an output terminal; a control circuit part controlling the operation of the output transistor; a switching circuit part connecting the substrate gate and the gate of the output transistor to one of the input terminal and the output terminal and one of the output of the control circuit part and the output terminal, respectively, in accordance with the relationship in magnitude between a voltage at an input terminal and a voltage at the output terminal; a first rectifier element connected between the input terminal and a power supply end; and a second rectifier element connected between the output terminal and the power supply end.

14 Claims, 5 Drawing Sheets

VOLTAGE REGULATOR

BACKGROUND OF THE INVENTION

1. Field of the Invention

The present invention relates generally to voltage regulators, and more particularly to a voltage regulator having the function of preventing reverse current flowing from the output side to the input side and protecting the circuit at the time of reverse connection of a direct current power supply where the direct current power supply is connected in reverse polarity to the voltage regulator.

2. Description of the Related Art

In conventional voltage regulars where circuits are formed of CMOS transistors, circuit failure may be caused by a large forward current caused to flow through a pn junction in a MOS transistor by reverse current flowing from the output side to the input side when a direct current (DC) power supply is connected in reverse polarity or an output voltage is greater than an input voltage. Therefore, conventionally, a PMOS transistor M102 is disposed between an input terminal IN and an output transistor M101 as shown in FIG. 1 so that the PMOS transistor M102 is turned OFF to be non-conducting when an output voltage VOUT is greater than an input voltage VIN or a DC power supply is connected in reverse polarity to the voltage regulator, thereby preventing circuit failure.

Although different from the present invention, there has been provided a reverse battery connection protection circuit that prevents damage to a semiconductor switching device in the case of reverse connection of a battery (for example, Patent Document 1 listed below). Further, there has also been provided a step-down switching regulator having a changeover switch to switch connections at the substrate gate of a switching transistor so as to be capable of preventing backflow of current without using a diode for backflow prevention even in the case of using a PMOS transistor for the switching device of the switching regulator (for example, Patent Document 2 listed below).

[Patent Document 1] Japanese Laid-Open Patent Application No. 2005-137190

[Patent Document 2] Japanese Laid-Open Patent Application No. 2006-34033

In the case of FIG. 1, however, there is a problem in that if the output transistor M101 is increased in size in order to increase output current, which is an index of the performance of the voltage regulator, the PMOS transistor M102 on the input terminal side should be greater in current driving capability than the output transistor M101, which runs against product downsizing. Further, there is another problem in that the resistance at the time of operation increases because the PMOS transistor M102 is connected in series to the output transistor M101.

SUMMARY OF THE INVENTION

Embodiments of the present invention may solve or reduce one or more of the above-described problems.

According to one aspect of the present invention, there is provided a voltage regulator in which one or more of the above-described problems may be solved or reduced.

According to one aspect of the present invention, there is provided a voltage regulator that can prevent generation of reverse current due to reverse connection of a power supply or a reversal of the relationship in magnitude between an input voltage and an output voltage with a simple circuit without degrading the resistance characteristic between the input terminal and the output terminal between which principal current flows, and thus can reduce product size.

According to one aspect of the present invention, there is provided a voltage regulator converting a voltage input to an input terminal into a predetermined constant voltage and outputting the constant voltage from an output terminal, the voltage regulator including an output transistor formed of a MOS transistor, the output transistor being configured to output a current according to an input control signal from the input terminal to the output terminal; a control circuit part configured to control an operation of the output transistor so that a voltage proportional to the voltage output from the output terminal is a predetermined reference voltage; a switching circuit part configured to connect a substrate gate of the output transistor to one of the input terminal and the output terminal and to connect a gate of the output transistor to one of an output of the control circuit part and the output terminal in accordance with a relationship in magnitude between a voltage at the input terminal and a voltage at the output terminal; a first rectifier element connected between the input terminal and a power supply end, from which power is supplied to the control circuit part and the switching circuit part, so as to allow current to flow from the input terminal to the control circuit part and the switching circuit part; and a second rectifier element connected between the output terminal and the power supply end so as to allow current to flow from the output terminal to the control circuit part and the switching circuit part.

According to a voltage regulator according to one embodiment of the present invention, the destination of the connection of the substrate gate of an output transistor is switched between an input terminal and an output terminal so that the substrate gate of the output transistor is connected to one of the input terminal and the output terminal, and the gate voltage of the output transistor is switched, in accordance with the relationship in magnitude between an input voltage and an output voltage. Further, the supply voltage of the circuit that controls the operation of the output transistor is supplied from the input terminal through a rectifier element or from the output terminal through a rectifier element. Accordingly, it is possible to prevent generation of reverse current in the case of reverse connection of a power supply or a reversal of the relationship in magnitude between the input voltage and the output voltage with a simple circuit without degrading the resistance characteristic between the input terminal and the output terminal between which principal current flows, and thus it is possible to reduce product size.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Next, a description is given, with reference to the accompanying drawings, of an embodiment of the present invention.

Figure 1:
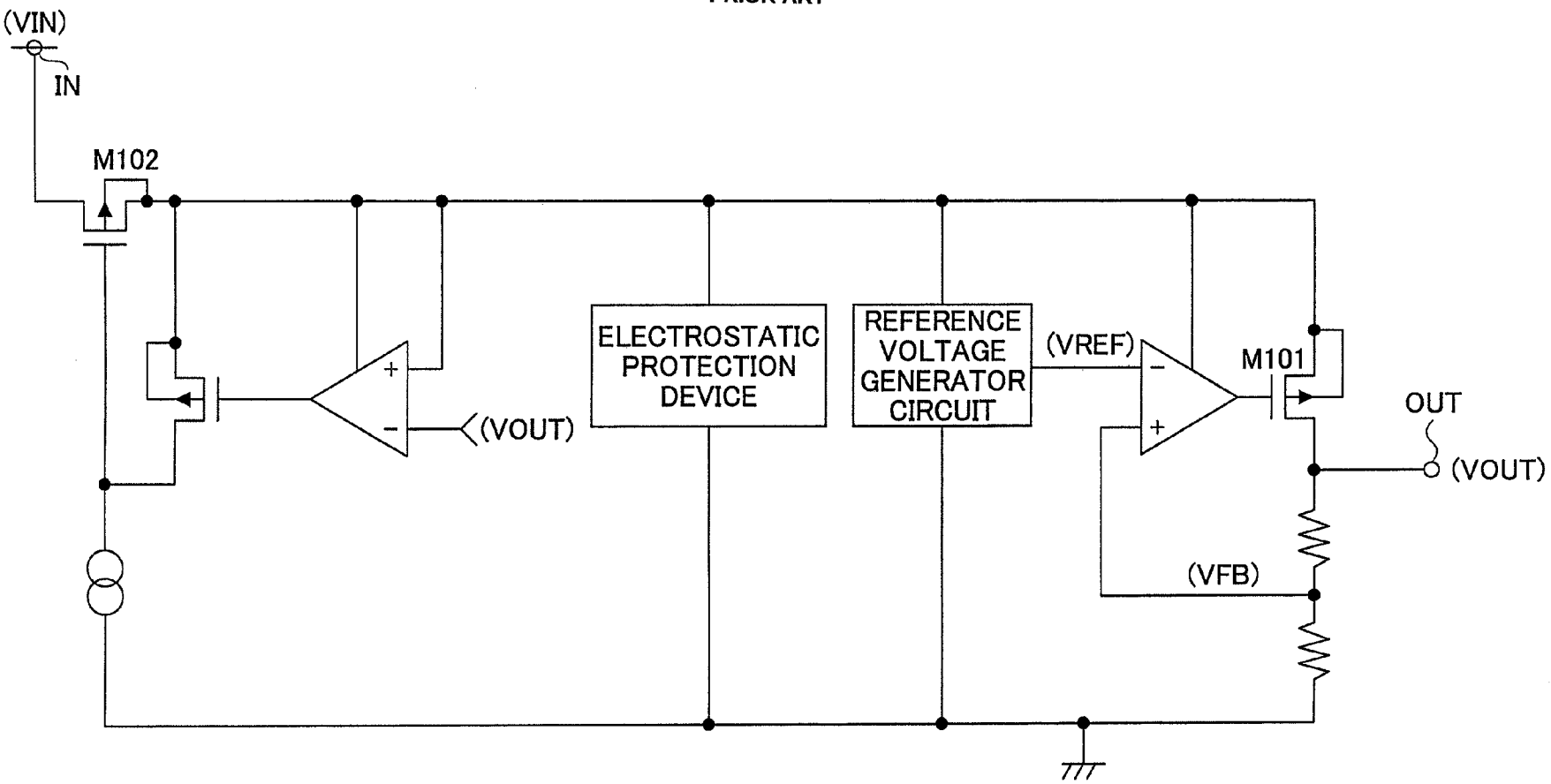
FIG.1 PRIOR ART
FIG. 1 is a diagram showing a conventional voltage regulator.
Figure 2:
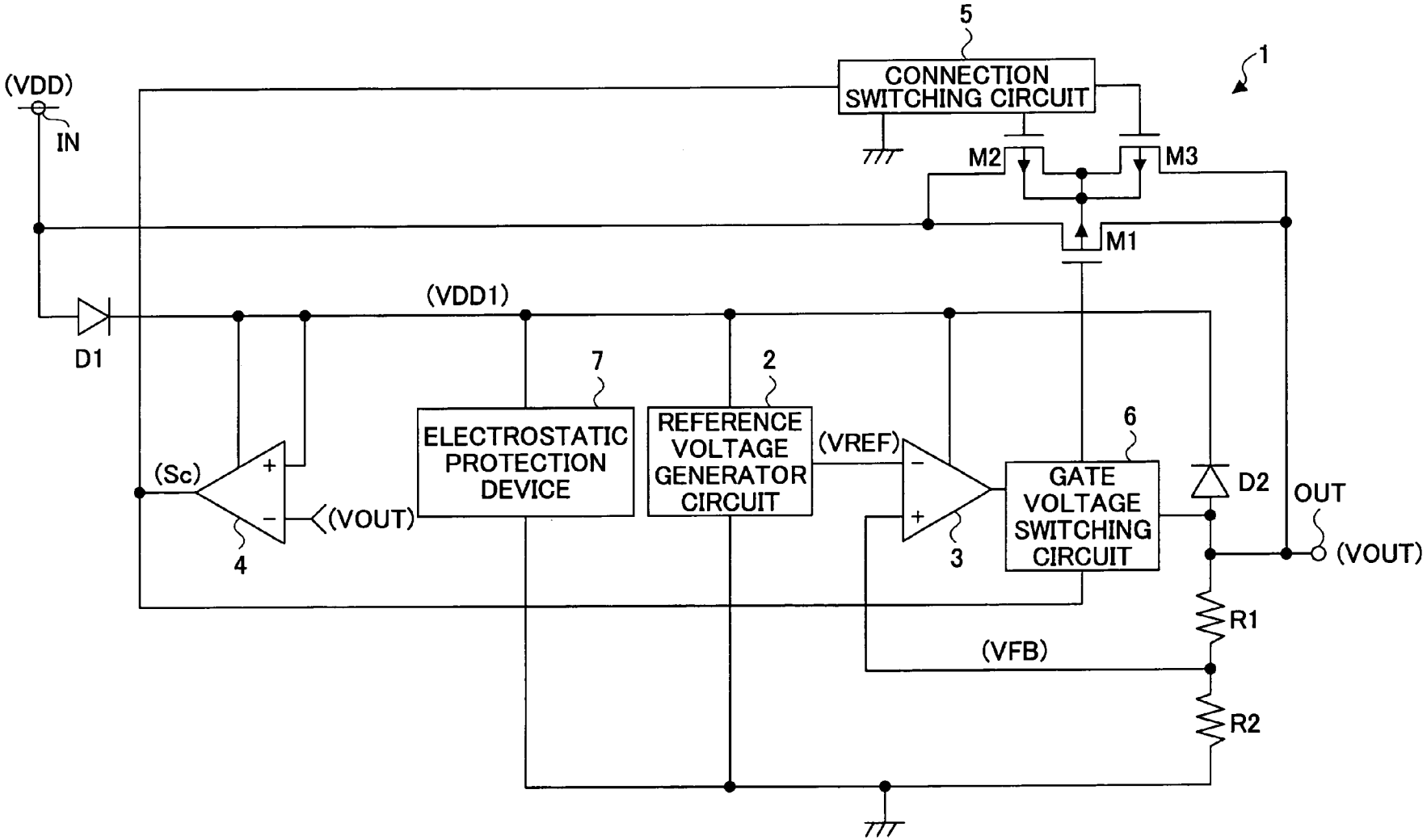
FIG. 2 is a diagram showing a circuit configuration of a voltage regulator according to an embodiment of the present invention.

FIG. 2 is a diagram showing a circuit configuration of a voltage regulator 1 according to the embodiment of the present invention.

Referring to FIG. 2, the voltage regulator 1 forms a step-down series regulator that generates a predetermined constant voltage from an input voltage VDD input to an input terminal IN and outputs the generated constant voltage from an output terminal OUT as an output voltage VOUT. The input voltage VDD forms a supply voltage input from a direct current (DC) power supply.

The voltage regulator 1 includes a reference voltage generator circuit 2 that generates and outputs a predetermined reference voltage VREF, a differential amplifier circuit 3, an output transistor M1 formed of a PMOS transistor, resistors R1 and R2 for output voltage detection, PMOS transistors M2 and M3 for switching the connection of the substrate gate (also referred to as back gate) of the output transistor M1, and a comparator 4 for detecting the output voltage VOUT being greater than the input voltage VDD. Further, the voltage regulator 1 includes a connection switching circuit 5, a gate voltage switching circuit 6, diodes D1 and D2, and an electrostatic protection device 7. The connection switching circuit 5 controls the operations of the PMOS transistors M2 and M3 in accordance with an output signal Sc of the comparator 4. The gate voltage switching circuit 6 switches the gate voltage of the output transistor M1 in accordance with the output signal Sc of the comparator 4.

The reference voltage generator circuit 2, the differential amplifier circuit 3, and the resistors R1 and R2 may form a control circuit part. The comparator 4, the connection switching circuit 5, and the gate voltage switching circuit 6 may form a switching circuit part. The comparator 4 may form a voltage comparator circuit part. The connection switching circuit 5 and the PMOS transistors M2 and M3 may form a connection switching circuit part. The gate voltage switching circuit 6 may form a gate voltage switching circuit part. The diode D1 may form a first rectifier element, and the diode D2 may form a second rectifier element. The PMOS transistor M2 may form a first switch, and the PMOS transistor M3 may form a second switch. The connection switching circuit 5 may form a switching control circuit. Further, the voltage regulator may be integrated into a single IC.

The output transistor M1 is connected between the input terminal IN and the output terminal OUT. A gate voltage is input to the gate of the output transistor M1 from the gate voltage switching circuit 6. Further, the PMOS transistors M2 and M3 are connected in series between the input terminal IN and the output terminal OUT. The connection of the PMOS transistors M2 and M3 is connected to the substrate gate of each of the output transistor M1 and the PMOS transistors M2 and M3. A gate voltage is input to the gate of each of the PMOS transistors M2 and M3 from the connection switching circuit 5.

Further, the anode of the diode D1 is connected to the input terminal IN, and the cathode of the diode D1 is connected to the cathode of the diode D2. The anode of the diode D2 is connected to the output terminal OUT.

The resistors R1 and R2 are connected in series between the output terminal OUT and ground. A divided (divisional) voltage VFB generated by dividing the output voltage VOUT is output from the connection of the resistors R1 and R2. The divided voltage VFB is input to the non-inverting input of the differential amplifier circuit 3. The reference voltage VREF is input to the inverting input of the differential amplifier circuit 3. The output terminal of the differential amplifier circuit 3 is connected to the gate voltage switching circuit 6, to which the output voltage VOUT is input. Further, a voltage VDD1 at a connection of the diode D1 and the diode D2 is input to the non-inverting input of the comparator 4. The output voltage VOUT is input to the inverting input of the comparator 4. The electrostatic protection device 7 is connected between the voltage VDD1 (the connection of the diodes D1 and D2) and ground. The reference voltage generator circuit 2, the differential amplifier circuit 3, the comparator 4, and further, depending on cases, the connection switching circuit 5 and the gate voltage switching circuit 6 each operate using the voltage VDD1 as a power supply. The voltage VDD1 forms a voltage at a power supply end.

According to this configuration, under normal conditions where the input voltage VDD is greater than the output voltage VOUT, the output signal Sc of the comparator 4 is HIGH (high-level), so that the connection switching circuit 5 causes the PMOS transistor M2 to turn ON to be conducting and causes the PMOS transistor M3 to turn OFF to be non-conducting. At the same time, the gate voltage switching circuit 6 outputs the output signal of the differential amplifier circuit 3 to the gate of the output transistor M1.

Under these conditions, the differential amplifier circuit 3 controls the operation of the output transistor M1 so as to equalize the divided voltage VFB with the reference voltage VREF, thereby controlling the output current of the output transistor M1.

Here, a description is given of an operation in the case where the output voltage VOUT becomes greater than the input voltage VDD.

Under this condition, the voltage VDD1 is equal to a voltage to which the voltage at the output terminal OUT is lowered by (the amount of) the forward voltage of the diode D2. The output signal Sc of the comparator 4 becomes LOW (low-level), so that the connection switching circuit 5 turns OFF the PMOS transistor M2 and turns ON the PMOS transistor M3, and that the gate voltage switching circuit 6 connects the gate of the output transistor M1 to the output terminal OUT. As a result, the output transistor M1 turns OFF to be non-conducting, and the substrate gate of the output transistor M1 is connected to the output terminal OUT. Accordingly, it is possible to prevent generation of reverse current flowing from the output terminal OUT to the input terminal IN.

Next, in the case of reverse connection where power is supplied with reverse polarity, the input voltage VDD becomes ground voltage and ground voltage becomes the input voltage VDD.

Under these conditions, if the voltage applied to the output terminal OUT is less than or equal to the sum of the input voltage VDD and the forward voltage of the diode D2, the diode D1 exhibits a reverse characteristic so as to prevent current from flowing from the ground side of FIG. 2 to the input terminal IN, so that the reference voltage generator circuit 2, the differential amplifier circuit 3, and the comparator 4 stop their respective operations. Here, the output stage of the comparator 4 forms an inverter so that a low-level signal is output from the output of the comparator 4 even when the operation of the comparator 4 is stopped. Therefore, the connection switching circuit 5 and the gate voltage switching circuit 6 perform their operations for the case where the output voltage VOUT is greater than the input voltage VDD, so that the connection switching circuit 5 turns OFF the PMOS transistor M2 and turns ON the PMOS transistor M3, and that the gate voltage switching circuit 6 connects the gate of the output transistor M1 to the output terminal OUT. As a result, the output transistor M1 turns OFF to be non-conducting.

On the other hand, if the voltage applied to the output terminal OUT is greater than the sum of the input voltage VDD and the forward voltage of the diode D2 in the condition of reverse connection, the voltage VDD1 is equal to a voltage to which the voltage at the output terminal OUT is lowered by (the amount of) the forward voltage of the diode D2. If the (voltage) difference between the voltage VDD1 and the input voltage VDD is a value sufficient to cause each of the reference voltage generator circuit 2, the differential amplifier circuit 3, and the comparator 4 to operate, the reference voltage generator circuit 2, the differential amplifier circuit 3, and the comparator 4 operate normally. At this point, however, the voltage at the output terminal OUT is greater than the voltage at the input terminal IN, so that the comparator 4 outputs a low-level signal (as the output signal Sc).

Therefore, the connection switching circuit 5 turns OFF the PMOS transistor M2 and turns ON the PMOS transistor M3, and the gate voltage switching circuit 6 connects the gate of the output transistor M1 to the output terminal OUT. As a result, the output transistor M1 turns OFF to be non-conducting. In this case, consequently, a current flows from the output voltage VOUT to the input voltage VDD through the reference voltage generator circuit 2, the differential amplifier circuit 3, and the comparator 4. However, this current is too small to cause a problem. The size of each of the diodes D1 and D2 may be such that a voltage drop caused in the current flowing through the reference voltage generator circuit 2, the differential amplifier circuit 3, and the comparator 4 is reduced. Therefore, the diodes D1 and D2 can be clearly smaller in size than the output transistor M1 that causes a large current to flow.

Figure 3:
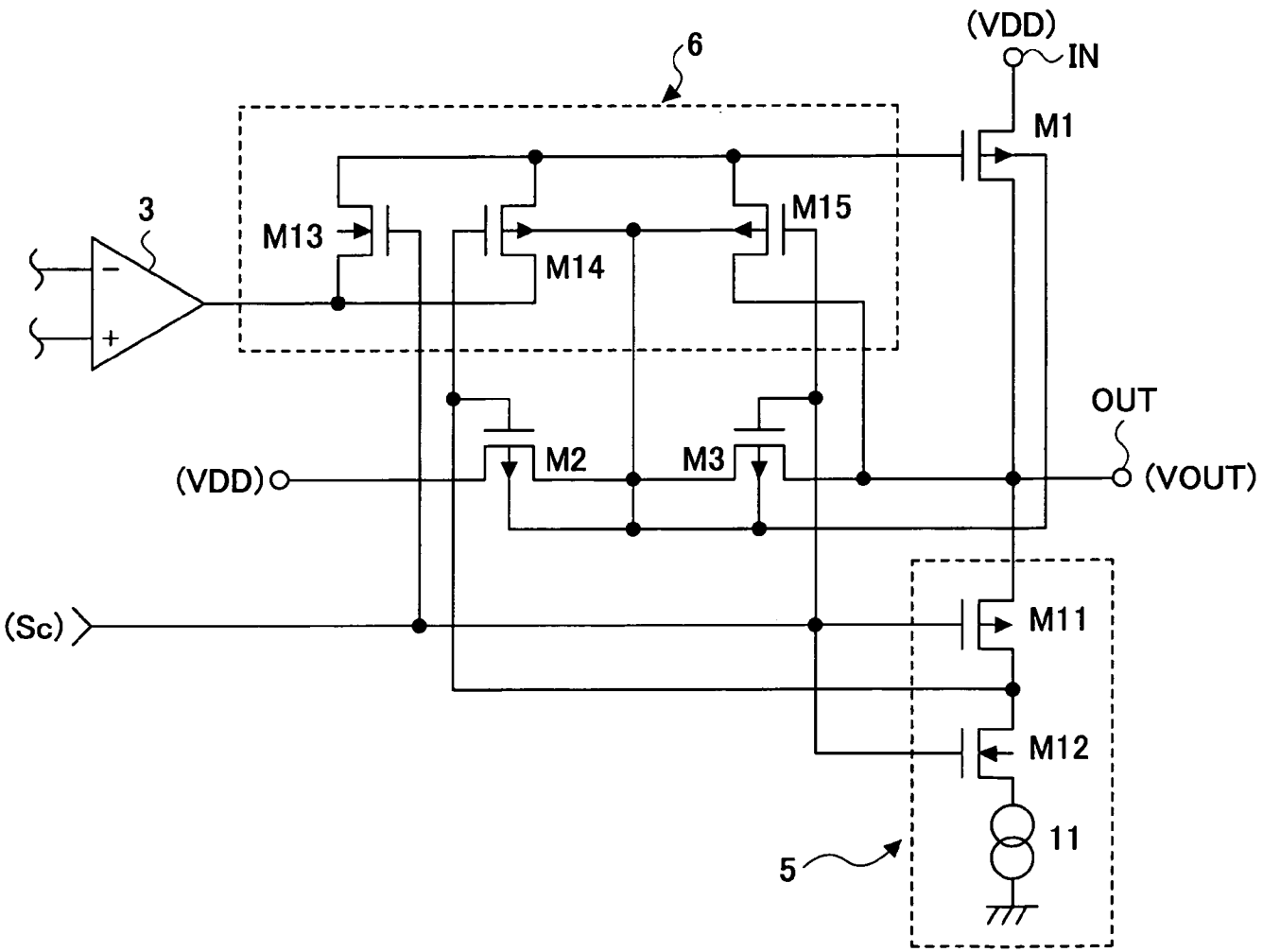
FIG. 3 is a diagram showing a configuration of a connection switching circuit and a gate voltage switching circuit of FIG. 2 according to the embodiment of the present invention.

FIG. 3 is a diagram showing a configuration of the connection switching circuit 5 and the gate voltage switching circuit 6 of FIG. 2. Referring to FIG. 3, the connection switching circuit 5 includes an inverter formed of a PMOS transistor M11, an NMOS transistor M12, and a constant current source 11. The gate voltage switching circuit 6 includes an NMOS transistor M13 and PMOS transistors M14 and M15. In the connection switching circuit 5, the PMOS transistor M11, the NMOS transistor M12, and the constant current source 11 are connected in series between the output terminal OUT and ground, and the output signal Sc of the comparator 4 is input to the gate of each of the PMOS transistor M11 and the NMOS transistor M12. Further, the connection of the PMOS transistor M11 and the NMOS transistor M12 is connected to the gate of the PMOS transistor M2. The output signal Sc of the comparator 4 is input to the gate of the PMOS transistor M3.

Next, in the gate voltage switching circuit 6, the NMOS transistor M13 and the PMOS transistor M14 are connected between the gate of the output transistor M1 and the output of the differential amplifier circuit 3. The NMOS transistor M13 and the PMOS transistor M14 form an analog switch. The output signal Sc of the comparator 4 is input to the gate of the NMOS transistor M13. The gate of the PMOS transistor M14 is connected to the connection of the PMOS transistor M11 and the NMOS transistor M12 of the connection switching circuit 5. The PMOS transistor M15 is connected between the gate of the output transistor M1 and the output terminal OUT. The output signal Sc of the comparator 4 is input to the gate of the PMOS transistor M15. The substrate gate of each of the PMOS transistors M14 and M15 is connected to the connection of the PMOS transistors M2 and M3.

First, a description is given of the case where power is supplied with normal polarity in this configuration.

At the time of normal operation, the output voltage VOUT is less than the voltage VDD1. Accordingly, the output signal Sc of the comparator 4 is HIGH. As a result, each of the NMOS transistor M13 and the PMOS transistor M14 turns ON to be conducting, and the PMOS transistor M15 turns OFF to be non-conducting. Accordingly, the output signal of the differential amplifier circuit 3 is input to the gate of the output transistor M1. Further, since the PMOS transistor M11 turns OFF to be non-conducting and the NMOS transistor M12 turns ON to be conducting, the PMOS transistor M2 turns ON to be conducting and the PMOS transistor M3 turns OFF to be non-conducting. As a result, the substrate gate of the output transistor M1 is connected to the input voltage VDD.

Next, if the output voltage VOUT becomes greater than the input voltage VDD, the output signal Sc of the comparator 4 becomes LOW. As a result, each of the NMOS transistor M13 and the PMOS transistor M14 turns OFF to be non-conducting and the PMOS transistor M15 turns ON to be conducting, so that the gate of the output transistor M1 is connected to the output voltage VOUT. Further, the PMOS transistor M2 turns OFF to be non-conducting and the PMOS transistor M3 turns ON to be conducting, so that the substrate gate of the output transistor M1 is connected to the output voltage VOUT.

Next, a description is given of the case of reverse connection where power is supplied with reverse polarity.

If a voltage applied to the output terminal OUT is less than or equal to the sum of the input voltage VDD and the forward voltage of the diode D2 in the condition of reverse connection, the diode D1 exhibits a reverse characteristic so as to prevent current from flowing from the ground side of FIG. 2 to the input terminal IN, so that the reference voltage generator circuit 2, the differential amplifier circuit 3, and the comparator 4 stop their respective operations. Since the comparator 4 outputs a low-level signal, each of the NMOS transistor M13 and the PMOS transistor M14 turns OFF to be non-conducting and the PMOS transistor M15 turns ON to be conducting, so that the gate of the output transistor M1 is connected to the output voltage VOUT. Further, the PMOS transistor M2 turns OFF to be non-conducting and the PMOS transistor M3 turns ON to be conducting, so that the substrate gate of the output transistor M1 is connected to the output voltage VOUT.

On the other hand, if the voltage applied to the output terminal OUT is greater than the sum of the input voltage VDD and the forward voltage of the diode D2 in the condition of reverse connection, the voltage VDD1 is equal to a voltage to which the voltage at the output terminal OUT is lowered by (the amount of) the forward voltage of the diode D2. If the (voltage) difference between the voltage VDD1 and the input voltage VDD is a value sufficient to cause each of the reference voltage generator circuit 2, the differential amplifier circuit 3, and the comparator 4 to operate, the reference voltage generator circuit 2, the differential amplifier circuit 3, and the comparator 4 operate normally. At this point, however, the voltage at the output terminal OUT is greater than the voltage at the input terminal IN, so that the comparator 4 outputs a low-level signal (as the output signal Sc).

Therefore, each of the NMOS transistor M13 and the PMOS transistor M14 turns OFF to be non-conducting and the PMOS transistor M15 turns ON to be conducting, so that the gate of the output transistor M1 is connected to the output voltage VOUT. Further, the PMOS transistor M2 turns OFF to be non-conducting and the PMOS transistor M3 turns ON to be conducting, so that the substrate gate of the output transistor M1 is connected to the output voltage VOUT.

Figure 4:
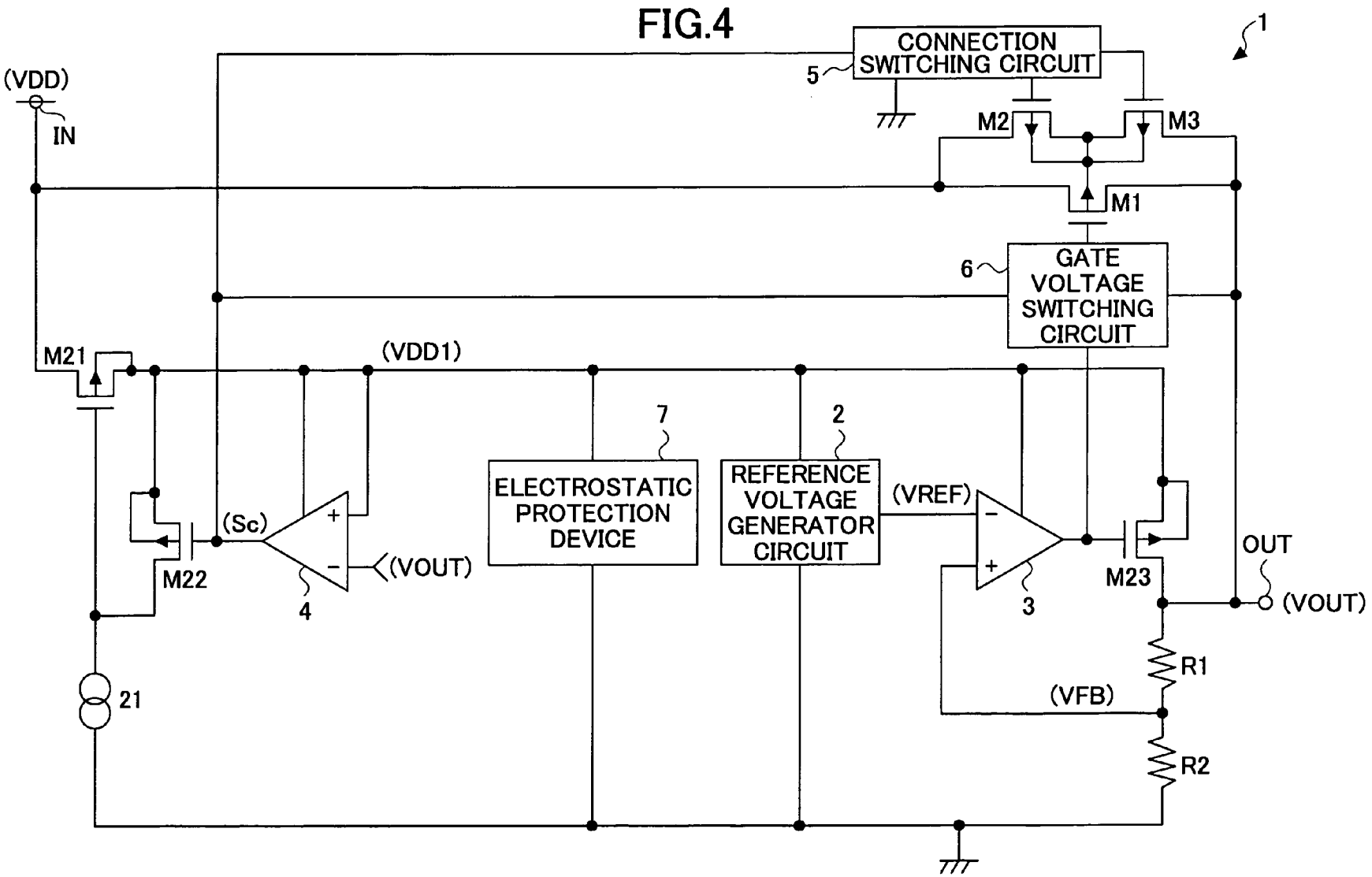
FIG. 4 is a diagram showing another circuit configuration of the voltage regulator according to the embodiment of the present invention.

Here, the diodes D1 and D2 of FIG. 2 may be replaced with transistors. In this case, the circuit configuration of the voltage regulator 1 shown in FIG. 2 may be modified as shown in FIG. 4. In FIG. 4, the same elements as or the elements similar to those of FIG. 2 are referred to by the same reference numerals, and a description thereof is omitted. Here, a description is given of differences from FIG. 2.

The circuit configuration of FIG. 4 is different from that of FIG. 2 in that PMOS transistors M21 and M22 and a constant current source 21 are used in place of the diode D1 of FIG. 2 and that a PMOS transistor M23 is used in place of the diode 2 of FIG. 2.

Referring to FIG. 4, the voltage regulator 1 includes the reference voltage generator circuit 2, the differential amplifier circuit 3, the output transistor M1, the resistors R1 and R2 for output voltage detection, the PMOS transistors M2, M3, and M21 through M23, the comparator 4, the connection switching circuit 5, the gate voltage switching circuit 6, the electrostatic protection device 7, and the constant current source 21. In FIG. 4, the PMOS transistor M21 may form a first rectifier element, the PMOS transistor M23 may form a second rectifier element, and the comparator 4, the connection switching circuit 5, the gate voltage switching circuit 6, the PMOS transistors M2, M3, and M22, and the constant current source 21 may form a switching circuit part.

The PMOS transistors M21 and M23 are connected in series between the input terminal IN and the output terminal OUT. A voltage at the connection of the PMOS transistors M21 and M23 is the voltage VDD1. The substrate gate of each of the PMOS transistors M21 and M22 is connected to the voltage VDD1. The constant current source 21 is connected between the gate of the PMOS transistor M21 and ground. The gate of the PMOS transistor M23 is connected to the output of the differential amplifier circuit 3. Further, the PMOS transistor M22 is connected between the voltage VDD1 and the gate of the PMOS transistor M21. The gate of the PMOS transistor M22 is connected to the output of the comparator 4, and the substrate gate of the PMOS transistor M22 is connected to the voltage VDD1.

According to this configuration, reverse current due to reverse polarity connection of the input terminal IN or a reversal of the relationship in magnitude between the input voltage VDD and the output voltage VOUT is prevented by interrupting current with parasitic diodes formed between a source and a substrate gate and between a drain and the substrate gate the same as in the case of FIG. 2. However, in the case of FIG. 4, the gate voltage of each of the PMOS transistors M21 and M23 can be controlled. Accordingly, unlike in the case of FIG. 2 where diodes are employed, it is possible to avoid voltage drops due to diodes, and the restriction that diodes having forward characteristics lower than the forward characteristic or threshold of the pn junction of the output transistor M1 should be employed is removed. Accordingly, it is possible to improve the difference between input and output voltages, which is an index of the performance of the voltage regulator. The size of each of the PMOS transistors M21 and M22 may be such that a voltage drop caused in the current flowing through the reference voltage generator circuit 2, the differential amplifier circuit 3, and the comparator 4 is reduced. Therefore, the PMOS transistors M21 and M22 can be clearly smaller in size than the output transistor M1 that causes a large current to flow.

Figure 5:
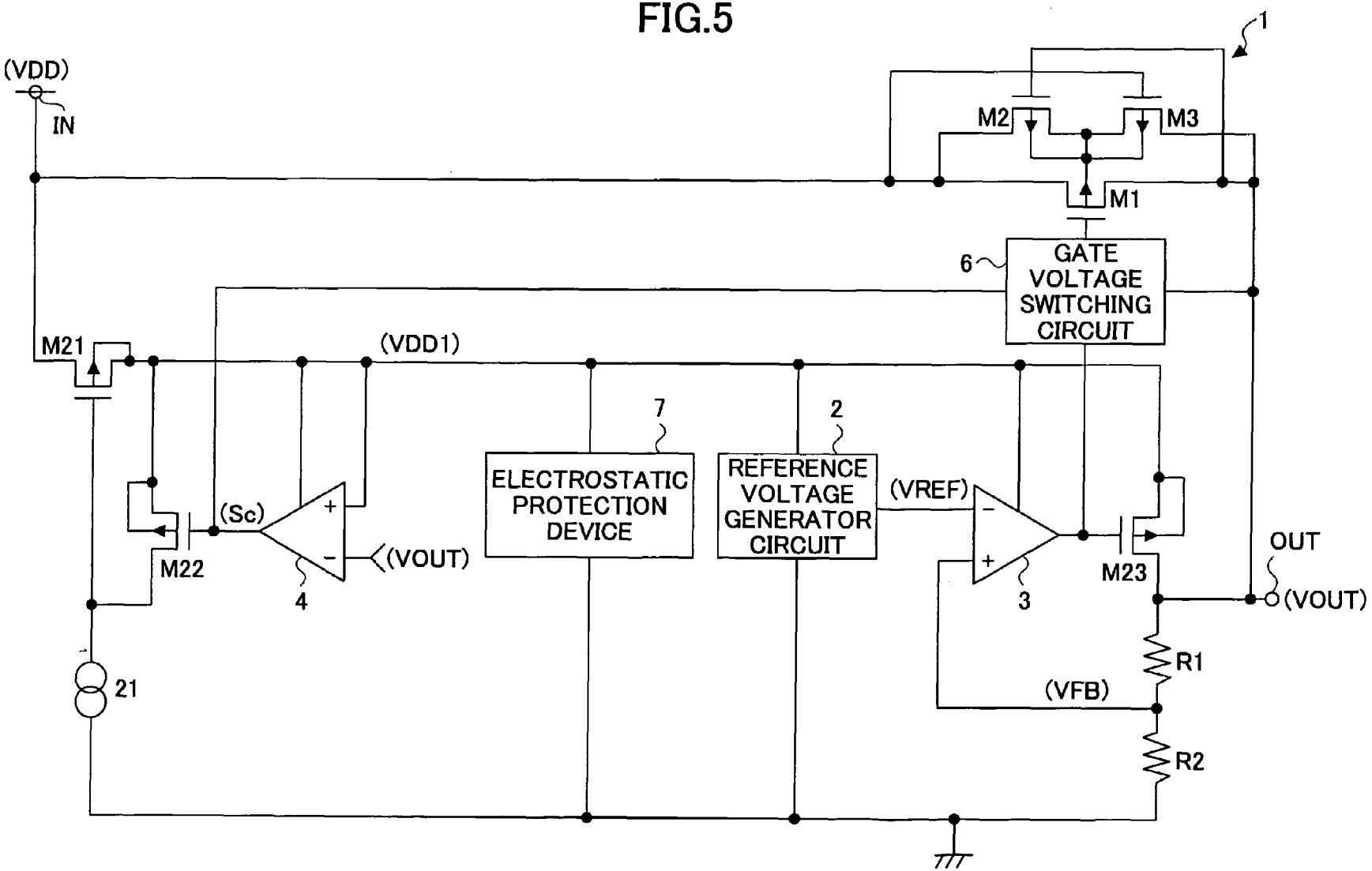
FIG. 5 is a diagram showing yet another circuit configuration of the voltage regulator according to the embodiment of the present invention.

Further, it is also possible to omit the connection switching circuit 5 and connect the gates of the PMOS transistors M2 and M3 to the output terminal OUT and the input terminal IN, respectively. In this case, the circuit configuration of the voltage regulator 1 shown in FIG. 4 may be modified as shown in FIG. 5. FIG. 5 shows the case of modifying FIG. 4 as an example, but the circuit configuration of FIG. 2 may also be modified in the same manner. In this case, the gates of the PMOS transistors M2 and M3 may be connected in the same manner as in the case of FIG. 5. The circuit configuration of FIG. 5 can produce the same effects as in the case of FIG. 4.

The substrate gate of each of the PMOS transistors M2 and M3 is connected to the substrate gate of the output transistor M1 in the above description, but may also be connected to the voltage VDD1.

Thus, according to the voltage regulator 1 of this embodiment, the destination of the connection of the substrate gate of the output transistor M1 is switched between the input terminal IN and the output terminal OUT so that the substrate gate of the output transistor M1 is connected to one of the input terminal IN and the output terminal OUT, and the gate voltage of the output transistor M1 is switched, in accordance with the relationship in magnitude between the input voltage VDD and the output voltage VOUT. Further, the supply voltage of the circuit that controls the operation of the output transistor M1 is supplied from the input terminal IN through a rectifier element or from the output terminal OUT through a rectifier element. Accordingly, it is possible to prevent generation of reverse current in the case of reverse connection of a power supply or a reversal of the relationship in magnitude between the input voltage VDD and the output voltage VOUT with a simple circuit without degrading the resistance characteristic between the input terminal IN and the output terminal OUT between which principal current flows, and thus it is possible to reduce product size.

Further, PMOS transistors may be used as a first rectifier element and a second rectifier element. Normally, the PMOS transistors are turned ON to be conducting, so that there are no voltage drops due to the first rectifier element and the second rectifier element. As a result, it is possible to reduce the difference between the input voltage VDD and the output voltage VOUT of the voltage regulator 1.

Further, the connection switching circuit 5 may be formed of two MOS transistors. As a result, it is possible to achieve circuit simplification.

According to one aspect of the present invention, there is provided a voltage regulator converting a voltage input to an input terminal into a predetermined constant voltage and outputting the constant voltage from an output terminal, the voltage regulator including an output transistor formed of a MOS transistor, the output transistor being configured to output a current according to an input control signal from the input terminal to the output terminal; a control circuit part configured to control the operation of the output transistor so that a voltage proportional to the voltage output from the output terminal is a predetermined reference voltage; a switching circuit part configured to connect the substrate gate of the output transistor to one of the input terminal and the output terminal and to connect the gate of the output transistor to one of the output of the control circuit part and the output terminal in accordance with the relationship in magnitude between a voltage at the input terminal and a voltage at the output terminal; a first rectifier element connected between the input terminal and a power supply end, from which power is supplied to the control circuit part and the switching circuit part, so as to allow current to flow from the input terminal to the control circuit part and the switching circuit part; and a second rectifier element connected between the output terminal and the power supply end so as to allow current to flow from the output terminal to the control circuit part and the switching circuit part.

The present invention is not limited to the specifically disclosed embodiment, and variations and modifications may be made without departing from the scope of the present invention.

The present application is based on Japanese Priority Patent Application No. 2006-192873, filed on Jul. 13, 2006, the entire contents of which are hereby incorporated by reference.

What is claimed is:

1. A voltage regulator converting a voltage input to an input terminal into a predetermined constant voltage and outputting the constant voltage from an output terminal, the voltage regulator comprising:

an output transistor formed of a MOS transistor, the output transistor being configured to output a current according to an input control signal from the input terminal to the output terminal;

a control circuit part configured to control an operation of the output transistor so that a voltage proportional to the voltage output from the output terminal is a predetermined reference voltage;

a switching circuit part configured to connect a substrate gate of the output transistor to one of the input terminal and the output terminal and to connect a gate of the output transistor to one of an output of the control circuit part and the output terminal in accordance with a relationship in magnitude between a voltage at the input terminal and a voltage at the output terminal;

a first rectifier element connected between the input terminal and a power supply end, from which power is supplied to the control circuit part and the switching circuit part, so as to allow current to flow from the input terminal to the control circuit part and the switching circuit part; and a second rectifier element connected between the output terminal and the power supply end so as to allow current to flow from the output terminal to the control circuit part and the switching circuit part.

2. The voltage regulator as claimed in claim 1, wherein the switching circuit part is configured to connect the substrate gate and the gate of the output transistor to the output terminal in response to the voltage at the output terminal becoming greater than the voltage at the input terminal.

3. The voltage regulator as claimed in claim 1, wherein the switching circuit part is configured to connect the substrate gate of the output transistor to the input terminal and the gate of the output transistor to the output of the control circuit part in response to the voltage at the output terminal becoming less than the voltage at the input terminal.

4. The voltage regulator as claimed in claim 1, wherein the switching circuit part comprises:

a voltage comparator circuit part configured to compare a voltage at the power supply end and the voltage at the output terminal and to generate and output a signal representing a result of the comparison;

a connection switching circuit part configured to connect the substrate gate of the output transistor to one of the input terminal and the output terminal in accordance with the output signal of the voltage comparator circuit part; and a gate voltage switching circuit part configured to connect the gate of the output transistor to one of the output of the control circuit part and the output terminal in accordance with the output signal of the voltage comparator circuit part.

5. The voltage regulator as claimed in claim 4, wherein the connection switching circuit part comprises:

a first switch configured to connect the substrate gate of the output transistor to the output terminal in accordance with an input first control signal;

a second switch configured to connect the substrate gate of the output transistor to the input terminal in accordance with an input second control signal; and a switching control circuit configured to control operations of the first switch and the second switch in accordance with the output signal of the voltage comparator circuit part.

6. The voltage regulator as claimed in claim 5, wherein:

each of the output transistor, the first switch, and the second switch comprises a PMOS transistor; and each of the PMOS transistors of the first switch and the second switch has a substrate gate thereof connected to the substrate gate of the output transistor.

7. The voltage regulator as claimed in claim 5, wherein:

each of the output transistor, the first switch, and the second switch comprises a PMOS transistor; and each of the PMOS transistors of the first switch and the second switch has a substrate gate thereof connected to the power supply end.

8. The voltage regulator as claimed in claim 1, wherein the switching circuit part comprises:

a voltage comparator circuit part configured to compare a voltage at the power supply end and the voltage at the output terminal and to generate and output a signal representing a result of the comparison;

a connection switching circuit part configured to connect the substrate gate of the output transistor to one of the input terminal and the output terminal in accordance with a voltage difference between the input terminal and the output terminal; and a gate voltage switching circuit part configured to connect the gate of the output transistor to one of the output of the control circuit part and the output terminal in accordance with the output signal of the voltage comparator circuit part.

9. The voltage regulator as claimed in claim 8, wherein the connection switching circuit part comprises:

a first MOS transistor connected between the input terminal and the substrate gate of the output transistor, and having a gate thereof connected to the output terminal; and a second MOS transistor connected between the output terminal and the substrate gate of the output transistor, and having a gate thereof connected to the input terminal.

10. The voltage regulator as claimed in claim 9, wherein:

each of the output transistor, the first MOS transistor, and the second MOS transistor comprises a PMOS transistor; and each of the first MOS transistor and the second MOS transistor has a substrate gate thereof connected to the substrate gate of the output transistor.

11. The voltage regulator as claimed in claim 9, wherein:

each of the output transistor, the first MOS transistor, and the second MOS transistor comprises a PMOS transistor; and each of the first MOS transistor and the second MOS transistor has a substrate gate thereof connected to the power supply end.

12. The voltage regulator as claimed in claim 1, wherein each of the first rectifier element and the second rectifier element is a diode.

13. The voltage regulator as claimed in claim 1, wherein:

the first rectifier element is a PMOS transistor having a substrate gate thereof connected to a source thereof and having a drain thereof connected to the input terminal, the PMOS transistor being configured to perform switching in accordance with a signal input from the switching circuit part, the signal representing a relationship in magnitude between the voltage at the input terminal and the voltage at the output terminal; and the second rectifier element is a PMOS transistor having a substrate gate thereof connected to a source thereof and having a drain thereof connected to the output terminal, wherein a control signal output from the control circuit part is input to a gate of the PMOS transistor, the control signal controlling the operation of the output transistor.

14. The voltage regulator as claimed in claim 1, wherein the output transistor, the control circuit part, the first rectifier element, the second rectifier element, and the switching circuit part are integrated into a single IC.

* * * * *